US006453518B1

(12) United States Patent
Adams et al.

(10) Patent No.: US 6,453,518 B1
(45) Date of Patent: Sep. 24, 2002

(54) HOLDER FOR SHEET MATERIAL

(75) Inventors: Duane D. Adams, Sidney; James A. Snitzer, Oneonta, both of NY (US)

(73) Assignee: The Mead Corporation, Dayton, OH (US)

( * ) Notice: Subject to any disclaimer, the term of this patent is extended or adjusted under 35 U.S.C. 154(b) by 62 days.

(21) Appl. No.: 09/632,956

(22) Filed: Aug. 4, 2000

(51) Int. Cl.[7] ..... B42F 1/10
(52) U.S. Cl. ..... 24/67.9
(58) Field of Search ..... 24/67.9, 67.11, 24/563, 11 R, 11 PP, 326, 545, 546, 555, 556, 561, 562, 564; 248/451, 452, 316.7

(56) References Cited

U.S. PATENT DOCUMENTS

| | | | | | |
|---|---|---|---|---|---|
| 292,412 | A | * | 1/1884 | Covell | |
| 803,464 | A | * | 10/1905 | Beck | |
| 923,412 | A | | 6/1909 | Dannhesier | |
| 1,428,900 | A | | 9/1922 | Oppenheimer | |
| 2,522,911 | A | * | 9/1950 | Weaver | |
| D168,491 | S | * | 12/1952 | Alvarez | |
| 2,940,455 | A | | 6/1960 | Guichard | 129/16 |
| 3,086,264 | A | * | 4/1963 | Tindall | |
| 3,168,954 | A | | 2/1965 | Von Herrmann | 211/50 |
| 3,195,850 | A | | 7/1965 | Steiner | 248/454 |
| 3,212,794 | A | | 10/1965 | Crossan et al. | 281/15 |
| 3,300,168 | A | * | 1/1967 | Gaudino | |
| 3,399,429 | A | | 9/1968 | Goodman | 24/66 |
| 3,591,013 | A | | 7/1971 | Von Herrmann | 211/50 |
| 3,606,507 | A | | 9/1971 | Williams, Jr. et al. | 312/184 |
| 3,814,368 | A | | 6/1974 | Freed | 248/316 |
| 3,983,602 | A | * | 10/1976 | Barry | |
| 4,010,517 | A | | 3/1977 | Kapstad | 24/67.11 |
| 4,105,127 | A | | 8/1978 | Holl | 211/124 |
| 4,629,075 | A | | 12/1986 | Hutten | 211/89 |
| 4,709,895 | A | | 12/1987 | Mardak | 248/460 |
| 4,773,545 | A | | 9/1988 | Jones | 211/89 |
| 4,899,974 | A | * | 2/1990 | Wear et al. | |
| 4,907,769 | A | | 3/1990 | Hunley, Jr. et al. | 248/185 |
| 4,947,524 | A | * | 8/1990 | Chang | |
| 4,953,714 | A | | 9/1990 | Paul | 211/36 |

(List continued on next page.)

*Primary Examiner*—James R. Brittain
(74) *Attorney, Agent, or Firm*—Lawrence P. Trapani

(57) ABSTRACT

An apparatus for holding sheet-like material, comprising an elongated frame. The frame includes a rear wall, a front wall, and an adjoining wall. The front and rear walls each have a free end, a joined end, and an interior side. The front and rear walls are disposed in opposing spaced relation such that their interior sides faces each other. The adjoining wall connects the joined ends of the rear and front walls together. The interior side of the rear wall includes a pair of spaced-apart projections at the free end of the rear wall. The interior side of the front wall has a curved portion at the free end of the front wall. The curved portion is in tight mating contact with the pair of projections. The free ends define an entry through which the sheet-like material is to be inserted. The entry is normally closed, and is openable by urging apart the front and rear walls. The rear, the front and the adjoining walls, together, define an elongated hollow that is configured to accommodate a wire binding. The adjoining wall contains a first recess configured to carry a writing implement when holding the sheet-like material in a vertical orientation. The front wall contains a second recess configured to carry a writing implement when holding the sheet-like material in a horizontal orientation.

6 Claims, 3 Drawing Sheets

U.S. PATENT DOCUMENTS 5,096,069 A 3/1992 Brandon ..... 211/45
5,184,375 A * 2/1993 Hoyt
5,249,336 A 10/1993 Miller ..... 24/67.5
5,309,605 A * 5/1994 Sato
D352,963 S * 11/1994 Siler
5,555,606 A * 9/1996 Chu
5,645,254 A 7/1997 Ng et al. ..... 248/206.2
5,669,635 A * 9/1997 Wilson et al.
5,711,430 A 1/1998 Andersen et al. ..... 211/45
5,774,946 A * 7/1998 Morgan
5,839,168 A * 11/1998 Elkins
5,910,351 A 6/1999 Davis et al. ..... 428/100
5,955,170 A * 9/1999 Davis et al.
5,992,887 A * 11/1999 Maruchi
6,141,838 A * 11/2000 Cooper
6,352,229 B1 * 3/2002 Adams

* cited by examiner

HOLDER FOR SHEET MATERIAL

BACKGROUND OF THE INVENTION

1. Technical Field

The present invention relates generally to hangers, holders, mounts, and supports for articles, and more particularly to a device that can hold, hang, support, mount or attach to a single sheet or multiple sheets of sheet-like material.

2. Background Art

A number of hangers, holders, mounts, and supports for single or multiple sheet-like material have been proposed. Examples of such devices are disclosed in the following U.S. Pat. Nos: 5,711,430 (1998) to Andersen et al.; 4,899,974 (1990) to Wear et al.; 4,773,545 (1988) to Jones; 4,629,075 (1986) to Hutten; 4,105,127 (1978) to Höll; 4,010,517 (1977) to Kapstad; 3,814,368 (1974) to Freed; 3,606,507 (1971) to Williams, Jr.; 3,399,429 (1968) to Goodman; 3,591,013 (1971) to Von Herrmann; 3,168,954 (1965) to Von Herrmann; and 1,428,900 (1922) to Oppenheimer.

U.S. Pat. Nos. 5,711,430 to Andersen et al., 3,814,368 to Freed, 3,591,013 to Von Herrmann, 3,399,429 to Goodman, and 3,168,954 to Von Herrmann all disclose sheet hangers requiring at least one sheet-clamping or wedging roller or ball. Single and multiple sheet articles may be hung, as suggested, e.g., by Von Herrmann U.S. Pat. No. (3,168,954). Goodman's hanger may also be used in the horizontal position. While these hangers have proven to be effective in some applications, they all suffer from the drawback of requiring more than one part. Further, they require at least one moving part. The requirement for multiple and moving parts normally leads to higher manufacturing and assembly costs. In addition, moving parts are more prone to wear and failure, or to jamming, than non-moving or single-piece articles of manufacture. Moreover, the hangers or holders proposed in these patents do not offer any ancillary holding capability, such as for pens or other implements.

U.S. Pat. Nos. 4,773,545 to Jones, 4,105,127 to Höll, and 4,010,517 to Kapstad, all disclose sheet hangers requiring at least one resilient or spring-like insert. Single and multiple sheet articles may be hung, as suggested, e.g., by Jones (in FIG. 5). While these hangers have also proven to be effective in some applications, they too suffer from the drawback and attendant costs of requiring more than one part. In addition, no ancillary holding capability (e.g., a pen tray) is suggested.

U.S. Pat. Nos. 4,899,974 to Wear et al., 4,629,075 to Hutten, 3,606,507 to Williams, Jr., and 1,428,900 to Oppenheimer, all disclose single-piece hangers. The hangers in Wear et al. and Hutten are made of a single extruded piece of plastic or plastics. However, they are designed primarily for hanging a single sheet of material. Their effectiveness for hanging multiple sheets is not clear. The hanger in Oppenheimer has an additional capability for holding a pencil. However, Oppenheimer does not appear to be suitable for holding a single sheet. Williams, Jr. discloses a conventional compression-type holder which does not easily receive a single flexible sheet.

OBJECTS AND SUMMARY OF THE INVENTION

It is therefore an object of the present invention to provide a holder for sheet material that avoids the limits and problems associated with the prior art.

It is another object of the present invention to provide a holder that is effective for hanging both single and multiple sheet products.

It is a further object of the present invention to provide a holder that is effective for hanging single-sheet erasable and laminate products.

It is yet another object of the present invention to provide a holder that is configured to hang wire bound sheet products.

It is yet a further object of the present invention to provide a sheet holder that contains a tray or receptacle for carrying a writing implement or other elongated implement when the holder is oriented to hang a sheet or sheets vertically.

It is still another object of the present invention to provide a sheet holder that contains a tray or receptacle for carrying a writing implement or other elongated implement when the holder is oriented to hold a sheet or sheets on a horizontal surface.

It is still a further object of the present invention to provide a holder for sheet material that is constructed of a single, extruded piece of material, to simplify manufacturing and assembly steps, minimize overall unit cost, and improve reliability.

It is yet still another object of the present invention to provide a sheet holder that mounts to a vertical surface by means of, e.g., magnetic strips, double-sided foam tape or mechanical fasteners.

These and other objects are attained in accordance with the present invention, a preferred embodiment of which will now be summarily described. In the preferred embodiment, an apparatus for holding a single sheet or multiple sheets of sheet-like material comprises an elongated frame. The frame includes a rear wall, a front wall, and an adjoining wall. The rear wall has a free end, a joined end, and an interior side. The front wall has a free end, a joined end, and an interior side. The front and rear walls are disposed in substantially opposing spaced relation such that the interior side of the front wall generally faces the interior side of the rear wall. The adjoining wall connects the joined ends of the rear and front walls together.

The interior side of the rear wall includes a pair of spaced-apart projections running along the free end of the rear wall. The interior side of the front wall has a curved portion at the free end of the front wall. The curved portion projects toward the interior side of the rear wall and is in tight mating contact with the pair of projections.

The free ends define an elongated entry through which a single sheet or multiple sheets are to be inserted. The entry is normally closed by the tight mating contact of the curved portion and the pair of projections. The entry is openable by urging apart the interior sides of the front and rear walls.

The rear, the front and the adjoining walls, together, define an elongated hollow that is shaped and dimensioned to accommodate a wire or spiral binding.

The adjoining wall has an exterior side and contains a first elongated recess on the exterior side. The first recess is configured to carry a writing implement when the apparatus is oriented to hold the single sheet or multiple sheets in a first orientation (e.g., a vertical orientation). The front wall has an exterior side and contains a second elongated recess on the exterior side. The second recess is configured to carry a writing implement when the apparatus is oriented to hold the single sheet or multiple sheets in a second orientation (e.g., a horizontal orientation). The curved portion of the interior side of the front wall is produced by a curve in the front wall, and this curve substantially defines the second recess.

BRIEF DESCRIPTION OF THE DRAWING

Further objects of the present invention will become apparent from the following description of the preferred embodiment with reference to the accompanying drawing, in which.

DETAILED DESCRIPTION OF THE PREFERRED EMBODIMENT

Figure 1:
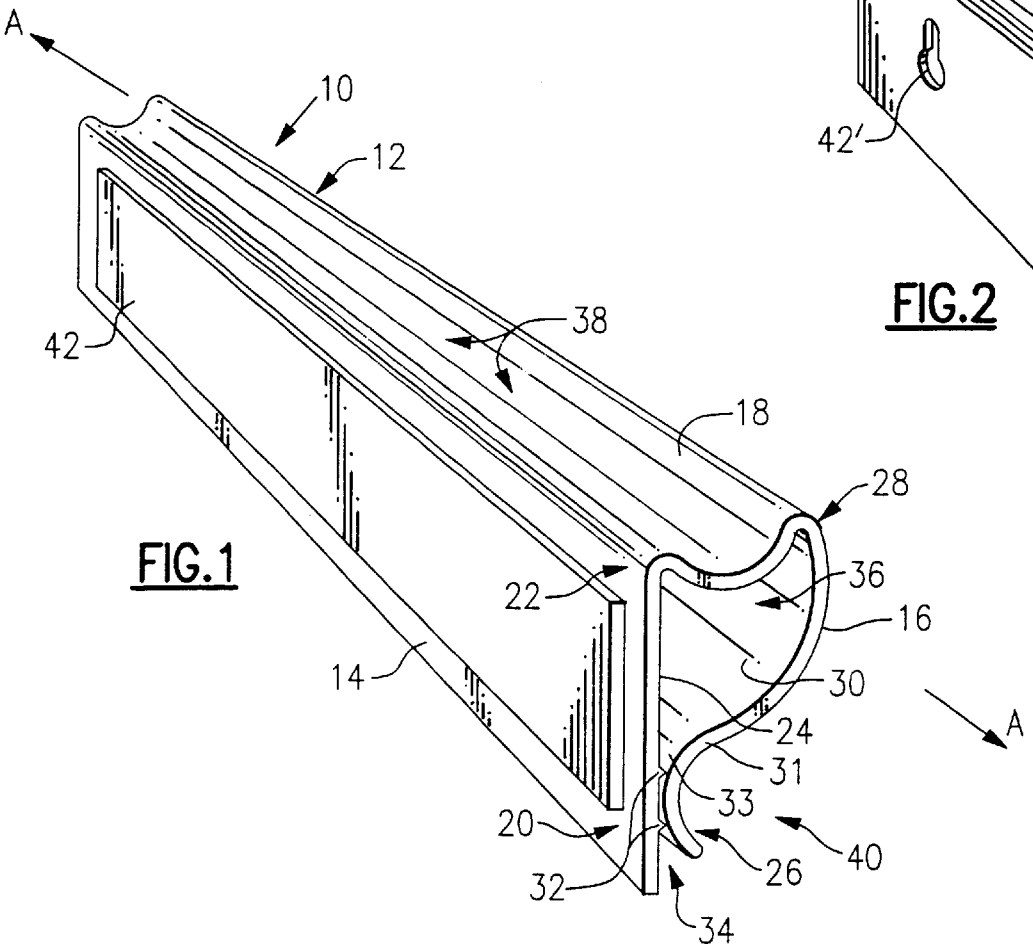
FIG. 1 is a rear perspective view of an apparatus for holding sheet-like material, constructed in accordance with the present invention, wherein the holding apparatus is shown with a magnetic strip for mounting the apparatus to a magnetically responsive vertical surface.

Referring now to FIG. 1, there is shown a holding apparatus 10 constructed in accordance with the preferred embodiment of the present invention. Apparatus 10 comprises an elongated frame 12 constructed as a single extruded piece of homogeneous plastic, such as polystyrene. Frame 12 has a longitudinal axis A—A (FIG. 1). Frame 12 has a rear wall 14, a front wall 16, and an adjoining wall 18. Rear wall 14 has a free end 20, a joined end 22, and an interior side 24. Front wall 16 has a free end 26, a joined end 28, and an interior side 30.

As shown in FIG. 1, rear and front walls 14, 16 are disposed in opposing spaced relation such that interior side 30 of front wall 16 generally faces interior side 24 of rear wall 14. Adjoining wall 18 is integrally connected to joined ends 22 and 28, and connects rear and front walls 14, 16 together.

A pair of spaced-apart elongated teeth or ribs 32 are integrally formed on interior side 24 of rear wall 14, at free end 20. Teeth 32 run the entire length of interior side 24 (not shown), and are disposed parallel to one another. Again, the embodiment described herein is the preferred embodiment. The invention is not limited to the structure (i.e., continuous elongated ribs) and arrangement (i.e., parallel) of the teeth shown in FIG. 1. For example, each continuous rib 32 may be replace with a train or series of discrete projections, or by a single discrete tooth or projection. Any equivalent pair of projections are within the scope of the present invention. Teeth 32 aid in securing a single sheet of sheet-like material as will be described in greater detail hereinbelow.

Figure 2:
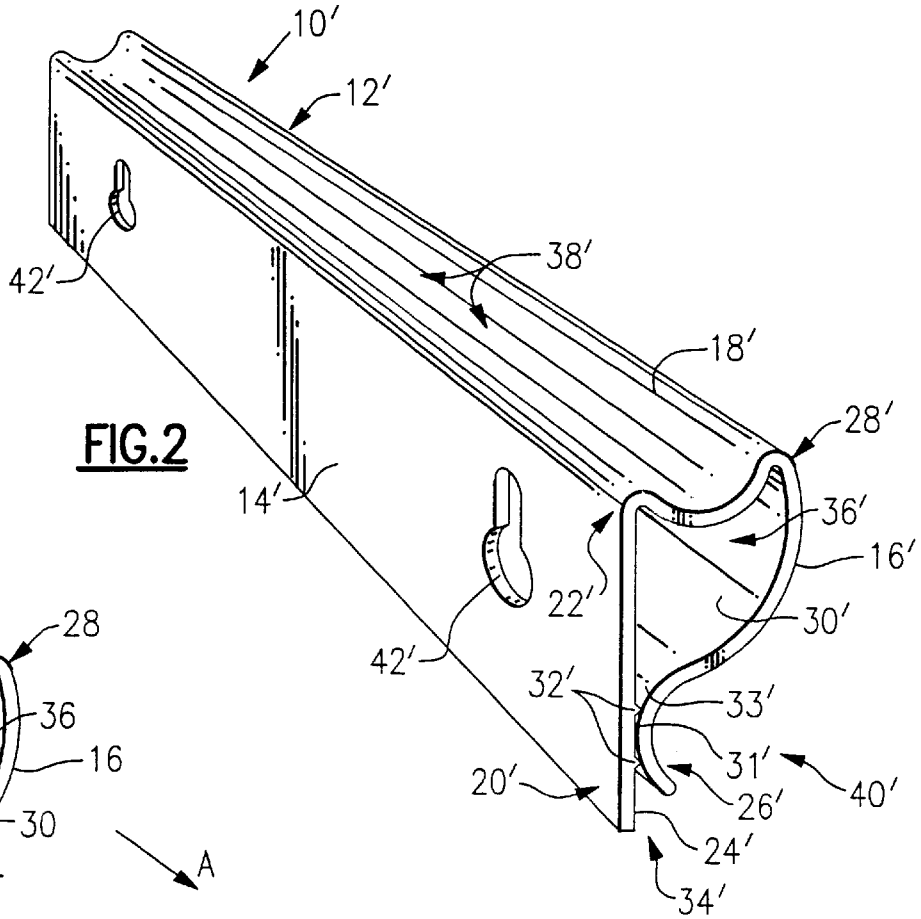
FIG. 2 is a rear perspective view of a holding apparatus of the present invention, wherein the apparatus is shown with slotted holes for mounting the apparatus to a vertical surface.

Interior side 30 of the front wall has a curved portion 31 at free end 26. Curved portion 31 projects toward the interior side of rear wall 14, and is in tight mating contact with teeth 32. In the preferred embodiment, curved portion 31 has a smooth surface 33 that extends into the space between teeth 32, but does not touch interior surface 24. A slight gap is maintained to allow for sheet material to be slid in and held. Teeth 32 are in tight contact with circumferentially displaced points along smooth surface 33 of curved portion 31, as best illustrated in FIGS. 1 and 2.

With further reference to FIG. 1, free ends 20 and 26 define an elongated entry 34 through which a single sheet or multiple sheets of material (to be held by apparatus 10) are to be inserted. As shown in FIGS. 1 and 2, entry 34 is normally closed by the tight mating contact of curved portion 31 and teeth 32. Entry 34 can be opened by urging apart front and rear walls 16 and 14. Rear, front and adjoining walls 14, 16, and 18, together, define an elongated hollow 36. Hollow 36 is shaped and dimensioned to accommodate a wire or spiral binding, as best illustrated in FIG. 4.

As shown in FIG. 1, adjoining wall 18 contains an elongated recessed area or recess 38 on the wall's exterior side. Recess 38 is configured to carry a writing implement when apparatus 10 is oriented or mounted to hold a sheet or sheets in a vertical orientation (e.g., see FIGS. 3 and 4). Front wall 16 contains an elongated recessed area or recess 40 on the front wall's exterior side. Recess 40 is configured to carry a writing implement when apparatus 10 is oriented or mounted to hold a sheet or sheets in a horizontal orientation (e.g., see FIGS. 5 and 6). Curved portion 31 of interior side 30 is produced by a curve in front wall 16. This curve defines recess 40 in front wall 16.

Apparatus 10 may be mounted to a surface by any conventional means, including, but not limited to magnetic strip, slotted holes, double-sided foam tape, suction cups, hooks, or tabs containing screw or nail holes. FIG. 1 shows, as an example, a magnetic strip 42 glued onto the exterior surface of rear wall 14. FIG. 2 shows a holding apparatus 10', which is identical to apparatus 10 except for the mounting means. The parts in FIG. 2 that are identical to those in FIG. 1 are numbered identically except they are "primed." As shown in FIG. 2, apparatus 10' contains slotted (or key) holes 42' for mounting apparatus 10' to a vertical surface.

Figure 3:
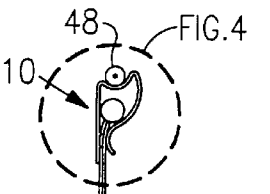
FIG. 3 is a side elevation view of a holding apparatus of the present invention, wherein the apparatus is shown holding a wire bound product, such as a wire bound wall calendar, in a vertical orientation.
Figure 4:
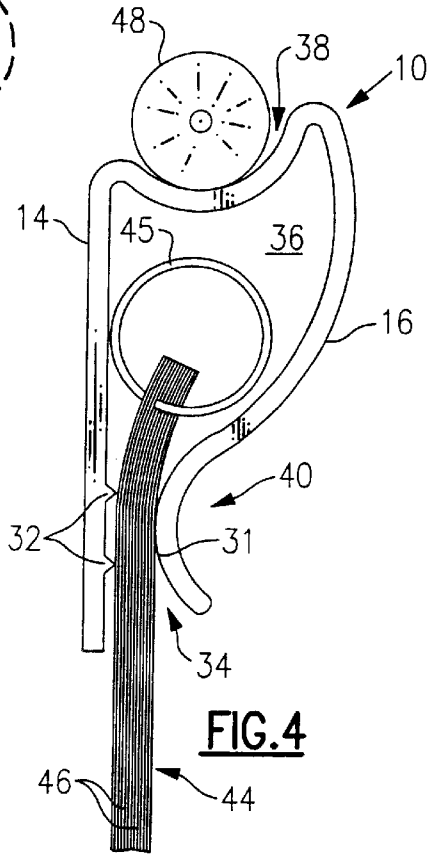
FIG. 4 is an enlarged view of the circled area marked "FIG. 4" in FIG. 3, showing the holding apparatus in greater detail.

FIGS. 3 and 4 illustrate an example of how apparatus 10 may be used. Apparatus 10 is shown holding (or hanging) a wire bound, multiple-sheet calendar 44 in a vertical orientation. Apparatus 10 may be mounted to a vertical surface in any known manner, as described above. Calendar 44 is slipped into apparatus 10 from the side. Hollow 36 is configured to accommodate a wire binding 45 of calendar 44. As shown in FIG. 4, the configuration of hollow 36 allows calendar 44 to hang by wire binding 45. Entry 34 is forced open by the multiple sheets 46 of calendar 44. Curved portion 31 and teeth 32, together, apply a compressive force on sheets 46. Calendar 44 is also held (or hung) as a result of this compressive force. Even if the multiple-sheet product did not have a wire binding (e.g., a simple pad of paper), the compressive force of curved portion 31 and teeth 32 would hold or hang the multiple sheets. Recess 38 functions as a tray for holding a writing implement when apparatus 10 is positioned in a vertical orientation. In FIGS. 3 and 4, a pen 48 is shown resting in recess 38. Of course, most types of writing implements may be held in recess 38.

Figure 5:
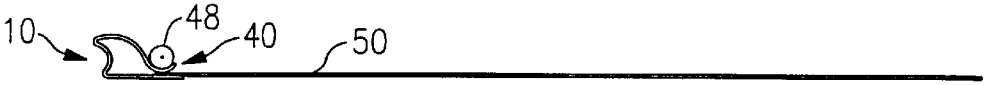
FIG. 5 is a side elevation view of a holding apparatus of the present invention, wherein the apparatus is shown holding a single sheet of material, such as a dry-erase board, in a horizontal orientation.
Figure 6:
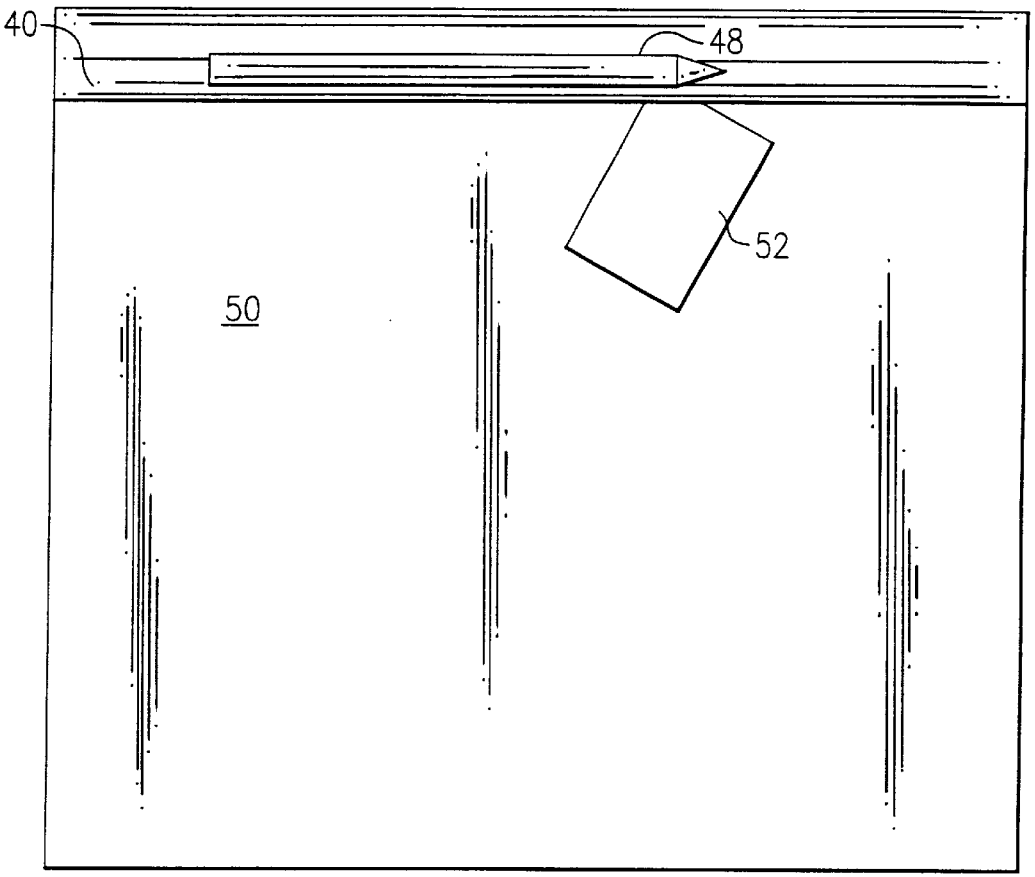
FIG. 6 is a top plan view of the holding apparatus of FIG. 5.

FIGS. 5 and 6 illustrate another example of how apparatus 10 may be used. Apparatus 10 is shown secured to a dry-erase board 50 in a horizontal orientation. Apparatus 10 is able to flex open to hold sheet-like material thicker than paper, such as board 50. Recess 40 functions as a tray for holding a writing implement when apparatus 10 is positioned in a horizontal orientation. In FIGS. 5 and 6, pen 48 is shown resting in recess 40. As shown in FIG. 6, apparatus 10 may also hold other articles such as a card 52.

Figure 7:
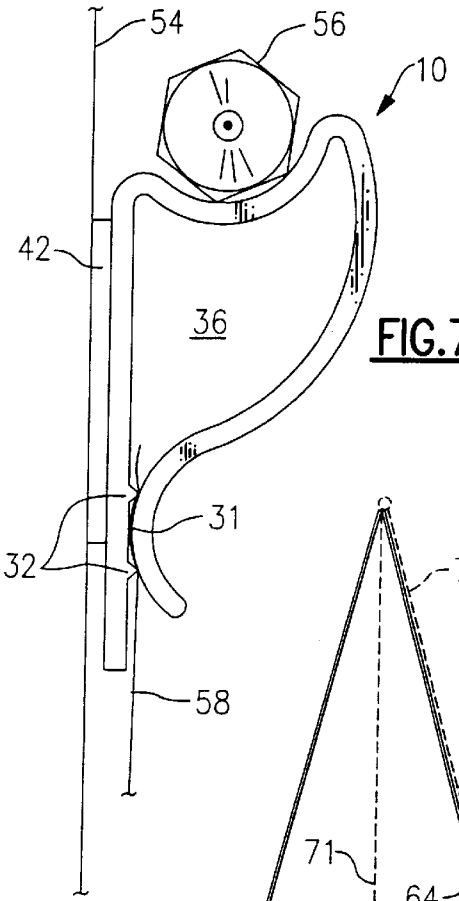
FIG. 7 is a side elevation view of a holding apparatus of the present invention, wherein the apparatus is shown holding a single sheet of laminated paper in a vertical orientation.

FIG. 7 illustrates a further example of how apparatus 10 may be used. Apparatus 10 is shown mounted to a metal vertical surface 54 in a vertical orientation. Magnetic strip 42 is the means for mounting apparatus 10 to surface 54. A pencil 56 is supported in recess 38. A single sheet of laminated paper 58 is held between teeth 32 and curved portion 31.

Figure 9:
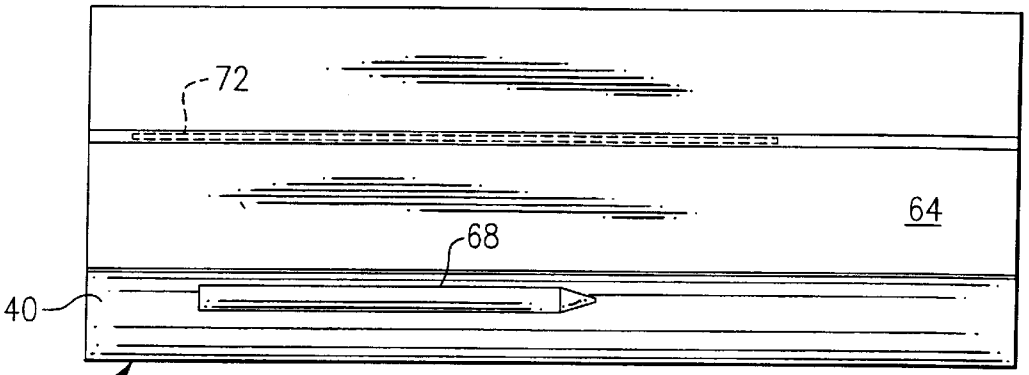
FIG. 9 is a top plan view of the holding apparatus and easel of FIG. 8.
Figure 10:
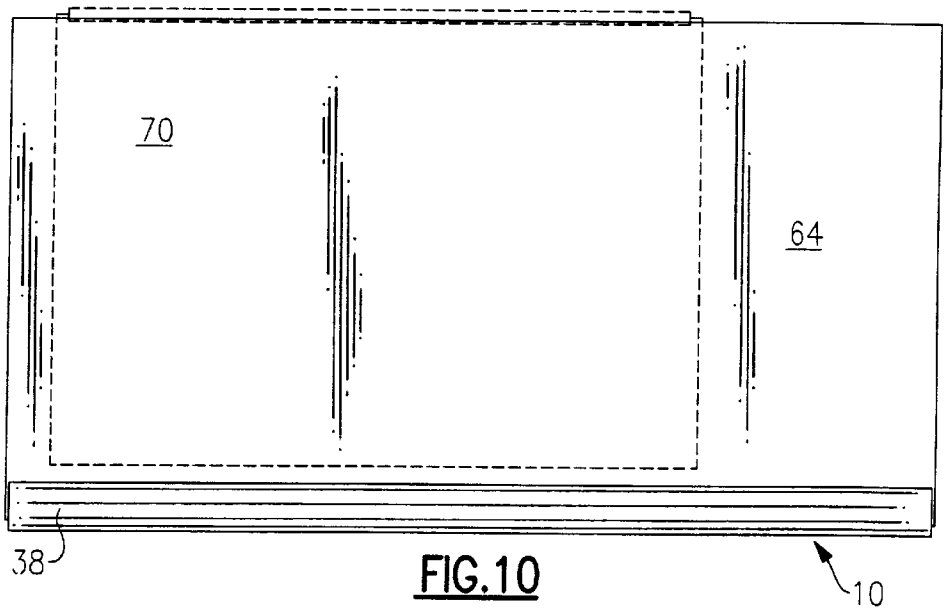
FIG. 10 is a front elevation view of the holding apparatus and easel of FIG. 8.
Figure 8:
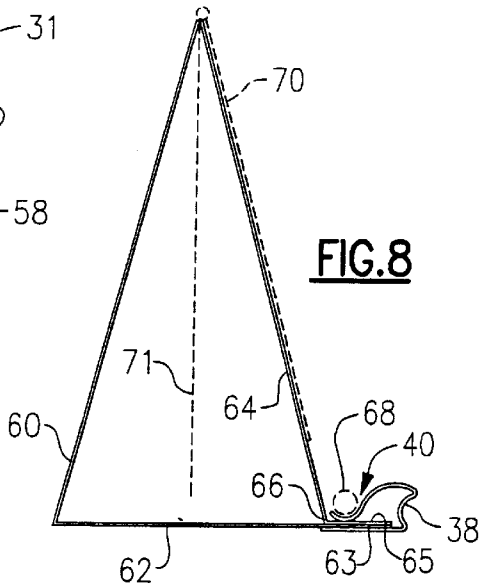
FIG. 8 is a side elevation view of a holding apparatus of the present invention holding an easel together and serving as a pen tray.

FIGS. 8–10 illustrates yet a further example of how apparatus 10 may be used. Apparatus 10 is used to hold a calendar or display easel 60 together and to serve as a pen or marker tray for the easel. A base 62 of easel 60 includes an extended portion 63. A front face 64 of easel 60 includes an extended portion 65 which is hinged or creased at point 66. Apparatus 10 is positioned in a horizontal orientation so that recess 40 serves as a tray for holding a marker 68. Extended portions 63, 65 are clamped together by apparatus 10, as best shown in FIG. 8. A wire bound calendar 70 may be mounted on easel 60 by sliding a back 71 of the calendar into a slot 72 contained at the top of easel 60 (FIGS. 8 and 9). In an alternative easel example, apparatus 10 may simply clamp onto an extended portion of the easel's base or onto a stop extending from the base.

The preferred method of constructing apparatus 10 is to extrude plastic material, such as polystyrene, through a die, producing a single plastic extruded part. As the plastic is extruded through the die, it is stretched, manipulated and guided into the desired profile. In order to achieve the tight mating contact between curved portion 31 with teeth 32, tension must be instilled in the plastic extruded part. This is accomplished by making sure that, as the plastic cools, its stays tight together at the points where curved portion 31 and teeth 32 are to make contact. By following this method of construction, a tight mating contact is achieved between curved portion 31 and teeth 32. By following this method of construction, apparatus 10 is able to hold a single sheet of laminate paper, and still function to hold a multiple-sheet product or a thick board product.

While the preferred embodiments of the invention have been particularly described in the specification and illustrated in the drawings, it should be understood that the invention is not so limited. Many modifications, equivalents and adaptations of the invention will become apparent to those skilled in the art without departing from the spirit and scope of the invention, as defined in the appended claims.

What we claim is:

1. An apparatus for holding a single sheet or multiple sheets, comprising an elongated frame, said frame including:

a rear wall having a free end, a joined end, and an interior side;

a front wall having a free end, a joined end, and an interior side, the front and the rear walls be disposed in substantially opposing spaced relation such that the interior side of the front wall generally faces the interior side of the rear wall, the front wall having an exterior side and containing a first elongated recess on the exterior side, the first recess being configured to carry a writing implement when said apparatus is oriented to hold the single sheet or the multiple sheets in a first orientation; and an adjoining wall connecting the joined ends of the rear and the front walls, the adjoining wall having an exterior side and containing a second elongated recess on the exterior side, the second recess being configured to carry a writing implement when said apparatus is oriented to hold the single sheet or the multiple sheets in a second orientation, the interior side of the rear wall including a pair of spaced-apart projections at the free end of the rear wall, the interior side of the front wall having a curved portion at the free end of the front wall, the curved portion projecting toward the interior side of the rear wall and being in tight mating contact with the pair of projections, the free ends defining an elongated entry through which the single sheet is or multiple sheets are to be inserted, the entry being normally closed by the tight mating contact of the curved portion and the pair of projections and being openable by urging apart the interior sides of the front and rear walls, the rear, the front and the adjoining walls together defining an elongated hollow that is shaped and dimensioned to accommodate a wire or spiral binding.

2. An apparatus for holding a single sheet or multiple sheets, comprising an elongated frame, said frame including:

a rear wall having a free end, a joined end, and an interior side;

a front wall having a free end, a joined end, and an interior side, the front and the rear walls be disposed in substantially opposing spaced relation such that the interior side of the front wall generally faces the interior side of the rear wall, the front wall having an exterior side and containing a first elongated recess on the exterior side, the first recess being configured to carry a writing implement when said apparatus is oriented to hold the single sheet or the multiple sheets in a first orientation; and an adjoining wall connecting the joined ends of the rear and the front walls, the adjoining wall having an exterior side and containing a second elongated recess on the exterior side, the second recess being configured to carry a writing implement when said apparatus is oriented to hold the single sheet or the multiple sheets in a second orientation, the interior side of the rear wall including a pair of spaced-apart projections at the free end of the rear wall, the interior side of the front wall having a curved portion at the free end of the front wall, the curved portion projecting toward the interior side of the rear wall and being in tight mating contact with the pair of projections, the curved portion being produced by a curve in the front wall, and the curve in the front wall substantially defining the first elongated recess, the free ends defining an elongated entry through which the single sheet is or multiple sheets are to be inserted, the entry being normally closed by the tight mating contact of the curved portion and the pair of projections and being openable by urging apart the interior sides of the front and rear walls, the rear, the front and the adjoining walls together defining an elongated hollow that is shaped and dimensioned to accommodate a wire or spiral binding.

3. An apparatus for holding a single sheet or multiple sheets, comprising an elongated frame, said frame including:

a rear wall having a free end, a joined end, and an interior side;

a front wall having a free end, a joined end, and an interior side, the front and the rear walls be disposed in substantially opposing spaced relation such that the interior side of the front wall generally faces, the interior side of the rear will, the front wall having an exterior side and containing a first elongated recess on the exterior side, the first recess being configured to carry a writing implement when said apparatus is oriented to hold the single sheet or the multiple sheets in a first orientation, and an adjoining wall connecting the joined ends of the rear and the front walls, the adjoining wall having an exterior side and containing a second elongated recess on the exterior side, the second recess being configured to carry a writing implement when said apparatus is oriented to hold the single sheet or the multiple sheets in a second orientation, the interior side of the rear wall including a pair of spaced-apart projections at the free end of the rear wall, the interior side of the front wall having a curved portion at the free end of the front wall, the curved portion projecting toward the interior side of the rear wall and being in tight mating contact with the pair of projections, the curved portion having a smooth surface and projecting toward the interior side of the rear wall and being in tight mating contact with the pair of projections, the free ends defining an elongated entry through which the single sheet is or multiple sheets are to be inserted, the entry being normally closed by the tight mating contact of the curved portion and the pair of projections and being openable by urging apart the interior sides of the front and rear walls, the rear, the front and the adjoining walls together defining an elongated hollow that is shaped and dimensioned to accommodate a wire or spiral binding.

4. The apparatus as recited in claim 3, wherein at least one of the pair of spaced-apart projections is an elongated rib.

5. The apparatus as recited in claim 3, wherein each of the pair of spaced-apart projections is an elongated rib.

6. The apparatus as recited in claim 3, further comprising mounting means, affixed to said frame, for mounting said frame to a surface.

* * * * *